US005927694A

United States Patent [19]

Montepiano

[11] Patent Number: 5,927,694

[45] Date of Patent: Jul. 27, 1999

[54] EASY PICKET POST

[76] Inventor: Robert Allen Montepiano, 12872 Cape Cottage La., Sylmar, Calif. 91342

[21] Appl. No.: 08/916,316

[22] Filed: Aug. 22, 1997

[51] Int. Cl.[6] ..... E04H 17/14

[52] U.S. Cl. ..... 256/64; 256/22; 256/19

[58] Field of Search ..... 256/65, 67, 66, 256/19, 59, 34, 64, 22; 52/155, 720.2, 736.3, 737.3

[56] References Cited

U.S. PATENT DOCUMENTS

| | | | |
|---|---|---|---|
| 185,597 | 12/1876 | Vansise | 52/155 |
| 188,372 | 3/1877 | Jones | 256/59 X |
| 238,013 | 2/1881 | Wirt | 52/736.3 X |
| 1,247,107 | 11/1917 | Graham | 256/19 |
| 2,867,041 | 1/1959 | McMillan | 52/155 X |
| 3,343,326 | 9/1967 | Sickler et al. | 52/155 X |
| 5,722,205 | 3/1998 | Gannaway | 52/155 |
| 5,755,431 | 5/1998 | Williams | 256/65 X |

FOREIGN PATENT DOCUMENTS

| | | | |
|---|---|---|---|
| 2032486 | 5/1980 | United Kingdom | 256/65 |
| 2169017 | 7/1986 | United Kingdom | 256/65 |

*Primary Examiner*—Lynne A. Reichard
*Assistant Examiner*—John R. Cottingham

[57] ABSTRACT

A easy picket post including a new and improved elongated post member. The post member has four sides, a top end and a bottom end. A bore hole is within the post member and extends the length of the post member. A flat spike member is provided for coupling with at least one of the four sides of the post member. Lastly, an elongated cylindrical shank member is included. The cylindrical shank member has a striking head and a tapered end for piercing the ground. The cylindrical shank member has a diameter for positioning of the cylindrical shank within the bore hole of the post member. The cylindrical shank supports the post member in a vertical orientation with respect to the ground when positioned within the bore hole.

1 Claim, 2 Drawing Sheets

EASY PICKET POST

BACKGROUND OF THE INVENTION

1. Field of the Invention

The present invention relates to a Easy picket post and more particularly pertains to providing a picket fence post having an elongated shank for mounting the post member into the ground and further including a flat stake for support.

2. Description of the Prior Art

The use of fence post is known in the prior art. More specifically, fence posts heretofore devised and utilized for the purpose of supporting the fence planks are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,135,192 to Winkler discloses a ground anchor. U.S. Pat. No. 5,165,663 to Wells discloses a ground anchor for fence post and driving member for installing it. U.S. Pat. No. 5,011,107 to Reece discloses a post anchor apparatus. U.S. Pat. No. 4,923,164 to Stenberg discloses a post support and anchor. U.S. Patent Des. 354,792 to Gill discloses a fence post anchor. Lastly, U.S. Patent Des. 314,328 to Cobb discloses a fence post anchor.

In this respect, the easy picket post according to the present invention substantially departs from the conventional concepts and designs of the prior art, and in so doing provides an apparatus primarily developed for the purpose of providing a picket fence post having an elongated shank for mounting the post member into the ground and further including a flat stake for support.

Therefore, it can be appreciated that there exists a continuing need for a new and improved easy picket post which can be used for providing a picket fence post having an elongated shank for mounting the post member into the ground and further including a flat stake for support. In this regard, the present invention substantially fulfills this need.

SUMMARY OF THE INVENTION

In view of the foregoing disadvantages inherent in the known types of fence posts now present in the prior art, the present invention provides an improved easy picket post. As such, the general purpose of the present invention, which will be described subsequently in greater detail, is to provide a new and improved easy picket post which has all the advantages of the prior art and none of the disadvantages.

To attain this, the present invention essentially comprises an elongated post member. The post member has four sides, with each side having an equal length, width and height. The post member has a top end and a bottom end. A bore hole is within the post member and extends the length of the post member. The bore hole has a diameter of about 17/32 inches and defines a top bore entry and a bottom bore exit. The top end has a pair of peg holes. Each of the pair of peg holes is adjacent the top bore entry. Included is a flat spike member. The flat spike member couples with at least one of the four sides of the post member. The spike member, when coupled with the post member, has an end point that extends beyond the bottom end of the post member. Also, an elongated cylindrical shank member with a striking head and a tapered end is provided. The tapered end is used to pierce the ground. The cylindrical shank member has a length of about 66 inches. The cylindrical shank member has a diameter for positioning of the cylindrical shank within the bore hole of the post member. The tapered end, when exiting the bottom bore exit of the post member, extends about 24 inches beyond the bottom end when positioned within the bore hole of the post member. The cylindrical shank supports the post member in a vertical orientation with respect to the ground when positioned within the bore hole. Lastly, a post cap with a generally rectangular base plate is provided. The base plate has a top surface with a ball mounted thereon. The base plate has a bottom surface with a pair of coupling pins projecting therefrom. The post cap is sized for positioning on the top end of the post member. The post member is coupled to the top end when the pair of coupling pins engage the pair of peg holes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved easy picket post which has all the advantages of the prior art fence posts and none of the disadvantages.

It is another object of the present invention to provide a new and improved easy picket post which may be easily and efficiently manufactured and marketed.

It is a further object of the present invention to provide a new and improved easy picket post which is of a durable and reliable construction.

An even further object of the present invention is to provide a new and improved easy picket post which is susceptible of a low cost of manufacture with regard to both materials and labor, and which accordingly is then susceptible of low prices of sale to the consuming public, thereby making such easy picket post economically available to the buying public.

Still yet another object of the present invention is to provide a new and improved easy picket post which provides in the apparatuses and methods of the prior art some of the advantages thereof, while simultaneously overcoming some of the disadvantages normally associated therewith.

Still another object of the present invention is to providing a picket fence post having an elongated shank for mounting the post member into the ground and further including a flat stake for support.

Lastly, it is an object of the present invention to provide a new and improved elongated post member. The post member has four sides, a top end and a bottom end. A bore hole is within the post member and extends the length of the post member. A flat spike member is provided for coupling with at least one of the four sides of the post member. Lastly, an elongated cylindrical shank member is included. The cylindrical shank member has a striking head and a tapered end for piercing the ground. The cylindrical shank member has a diameter for positioning of the cylindrical shank within the bore hole of the post member. The cylindrical shank supports the post member in a vertical orientation with respect to the ground when positioned within the bore hole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
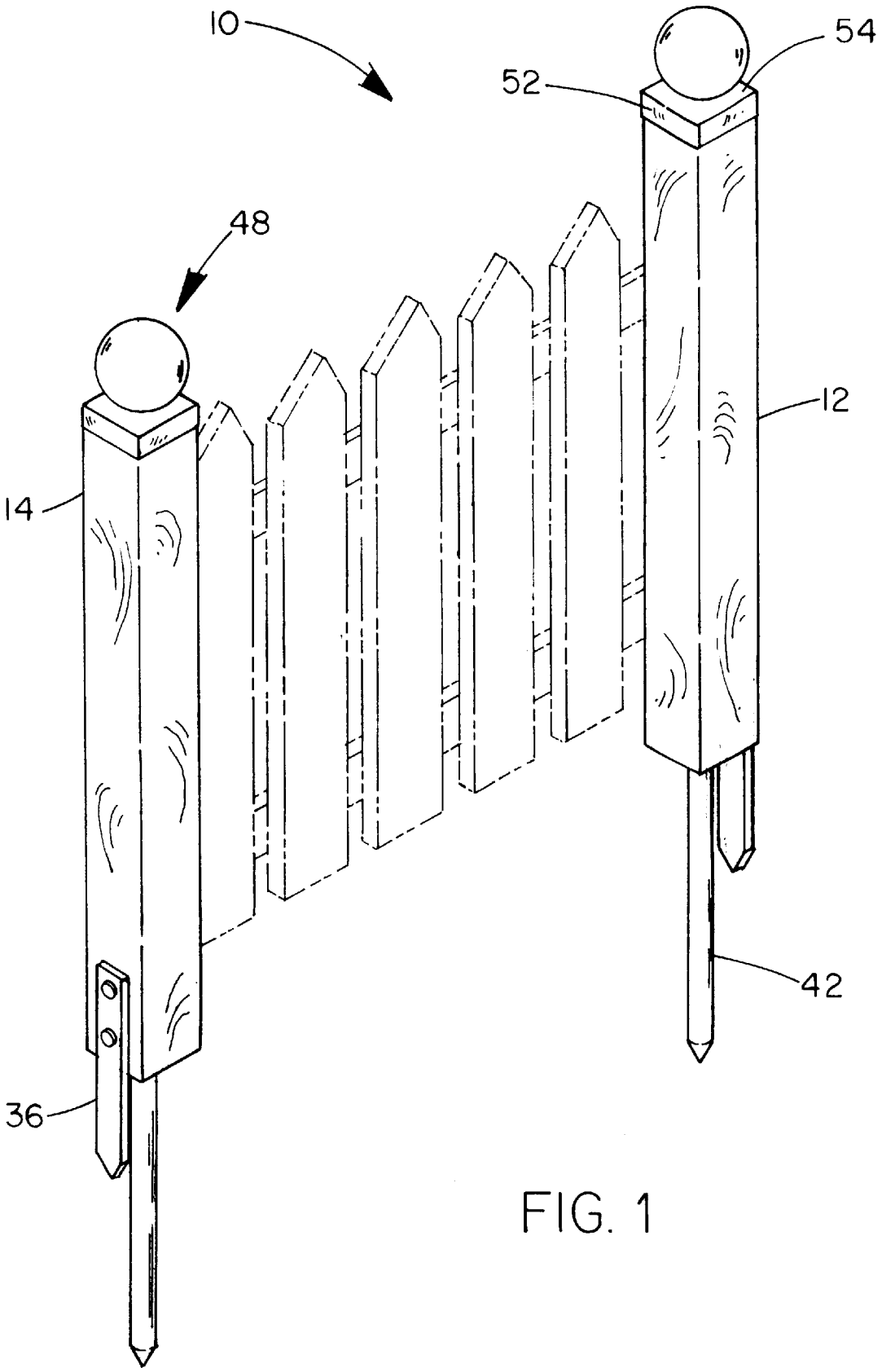
FIG. 1 is a perspective illustration of the preferred embodiment of the Easy picket post constructed in accordance with the principles of the present invention.

With reference now to the drawings, and in particular to FIG. 1 thereof, a new and improved easy picket post embodying the principles and concepts of the present invention and generally designated by the reference numeral 10 will be described.

The present invention, the new and improved easy picket post, is comprised of a plurality of components. Such components in their broadest context include a post member, a spike and a shank. Such components are individually configured and correlated with respect to each other so as to attain the desired objective.

Figure 2:
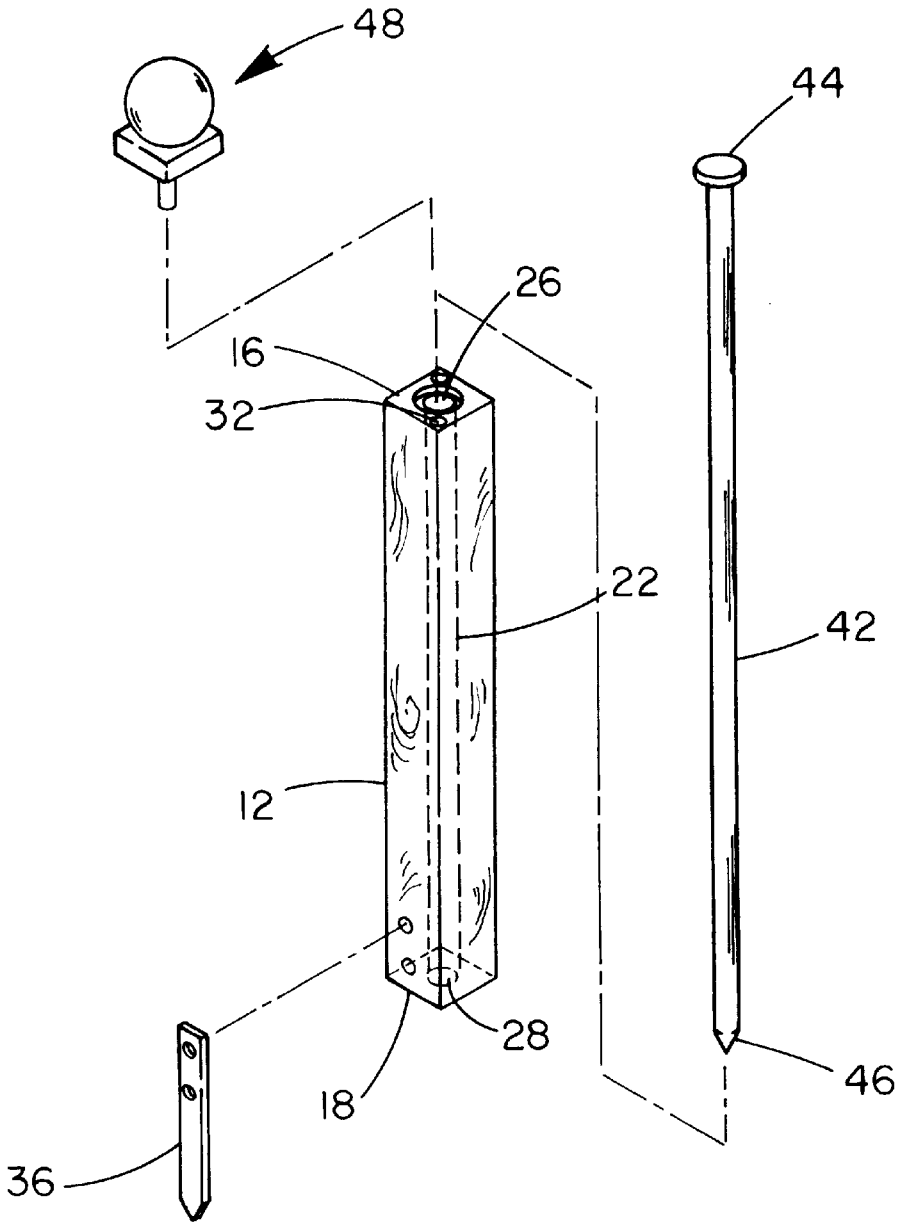
FIG. 2 is an exploded view of the operable components of the present invention.
Figure 3:
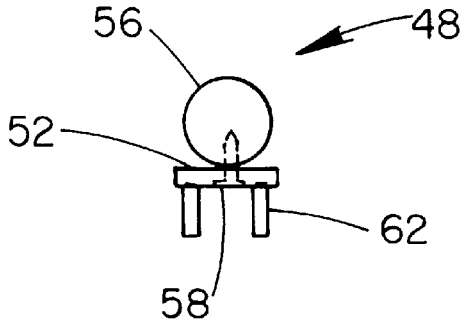
FIG. 3 is an isometric view of the post cap of the present invention.

More specifically, the present invention includes an elongated post member 12. The post member has four sides 14, with each side having an equal length, width and height. The post member, as shown in FIG. 2, has a top end 16 and a bottom end 18. A bore hole 22 is within the post member and extends the length of the post member. The bore hole has a diameter of about 17/32 inches. The bore hole defines a top bore entry 26 and a bottom bore exit 28. The top end has a pair of peg holes 32. Each of the pair of peg holes is adjacent the top bore entry.

Included is a flat spike member 36. The flat spike member couples with at least one of the four sides of the post member, as shown in FIG. 1. The spike member, when coupled with the post member, has an end point that extends beyond the bottom end 18 of the post member.

Also, an elongated cylindrical shank member 42 is provided. The shank member has a striking head 44 and a tapered end 46. The tapered end is used to pierce the ground. The cylindrical shank member has a length of about 66 inches. The cylindrical shank member has a diameter for positioning of the cylindrical shank within the bore hole of the post member. The striking head is used as a striking surface of pounding the shank through the bore hole and into the ground. The tapered end, when exiting the bottom bore exit 28 of the post member, extends about 24 inches beyond the bottom end when positioned within the bore hole of the post member. The cylindrical shank supports the post member in a vertical orientation with respect to the ground when positioned within the bore hole. When the post is in the vertical orientation, several post can be line up and have fence post attached.

Lastly, a post cap 48 with a generally rectangular base plate 52 is provided. The base plate has a top surface 54 with a ball 56 mounted thereon. The base plate has a bottom surface 58 with a pair of coupling pins 62 projecting therefrom. The post cap is sized for positioning on the top end of the post member. The post member is coupled to the top end when the pair of coupling pins engage the pair of peg holes 32.

The present invention easy picket post is a 4×4 post hollowed out 17/32 inches with a ½ inch steel shank protruding from the bottom of the post. The shank protrudes from the post member approximately 24 inches. The striking head is recessed within the top end when the shank is completely through the post.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An easy picket post comprising in combination:

an elongated post member with four sides each having an equal length, width, and height, the post member having a top end and a bottom end, a bore hole within the post member extending the length of the post member, the bore hole having a diameter of about 17/32 inches and defining a top bore entry and a bottom bore exit, the top end having a pair of peg holes, each of the pair of peg holes being adjacent the top bore entry, and wherein the top end having a countersink bore concentrically surrounding the bore hole;

a planar flat spike member coupled to at least one of the four sides of the post member and extending in an essentially common plane with such side, the spike member when coupled with the post member having an end point extending beyond the bottom end of the post member;

an elongated cylindrical shank member having an enlarged circular striking head and a tapered end for piercing the ground, the enlarged circular striking head fitting into the countersink bore, the cylindrical shank member having a length of about 66 inches, the cylindrical shank member having a diameter for positioning of the cylindrical shank within the bore hole of the post member, the tapered end exiting the bottom bore exit of the post member and extending about 24 inches beyond the bottom end when positioned within the bore hole of the post member, the cylindrical shank supporting the post member in a vertical orientation with respect to the ground when positioned within the bore hole; and a post cap having a generally rectangular base plate, the base plate having a top surface with a ball mounted thereon, the base plate having a bottom surface with a pair of coupling pins projecting therefrom, the post cap being sized for positioning on the top end of the post member, the post member being coupled to the top end when the pair of coupling pins engage the pair of peg holes.

* * * * *